US006725814B1

(12) United States Patent
Truong

(10) Patent No.: US 6,725,814 B1
(45) Date of Patent: Apr. 27, 2004

(54) SUPPLEMENTAL MODEL CAR ENGINE COOLING SYSTEM

(76) Inventor: Phu Truong, 1283 Shafter Ave., San Francisco, CA (US) 94124

( * ) Notice: Subject to any disclaimer, the term of this patent is extended or adjusted under 35 U.S.C. 154(b) by 47 days.

(21) Appl. No.: 10/104,941

(22) Filed: Mar. 22, 2002

(51) Int. Cl.[7] ..... F01P 9/04
(52) U.S. Cl. ..... 123/41.57
(58) Field of Search ..... 123/41.57, 458, 123/41.44

(56) References Cited

U.S. PATENT DOCUMENTS 4,825,816 A * 5/1989 Yamada et al. ..... 123/41.57
4,928,651 A * 5/1990 Kronich ..... 123/41.57
5,186,137 A * 2/1993 Salzmann ..... 123/192.2
5,836,545 A * 11/1998 Arlton et al. ..... 244/60
5,954,016 A * 9/1999 Westerbeke, Jr. ..... 123/41.57
6,079,392 A * 6/2000 Matsuda ..... 123/458
6,367,345 B1 * 4/2002 Yeh ..... 74/377

OTHER PUBLICATIONS

Derek Buono, "Set Up Nitro Bodies" Internet Reference http://www.rcnitro.com/articles/nitrobodies 1. asp.*
Randy Villines, Internet Reference http://www.rcfaq.com/answers/engines/watercooled.htm.*

* cited by examiner

*Primary Examiner*—Henry C. Yuen
*Assistant Examiner*—Jason Benton
(74) *Attorney, Agent, or Firm*—William Keyworth; Bill & Mary Lou Inc.

(57) ABSTRACT

Liquid-cooling the engine cylinder head augments air-cooling of a model car engine. This provides additional heat transfer from the engine in a location on the car chassis remote from the engine. This supplemental cooling allows improved engine performance and reduces car operating problems and damage related to high engine operating temperatures.

5 Claims, 3 Drawing Sheets

SUPPLEMENTAL MODEL CAR ENGINE COOLING SYSTEM

CROSS-REFERENCE TO RELATED APPLICATIONS

Not applicable.

STATEMENT REGARDING FEDERALLY SPONSORED RESEARCH AND DEVELOPMENT

Not Applicable.

REFERENCE TO A MICROFICHE APPENDIX

Not Applicable.

BACKGROUND OF THE INVENTION

1. Field of the Invention

This invention relates to a radio-controlled model car engine cooling system using both air-cooling and water-cooling of the engine cylinder head.

2. Description of Related Art

Internal combustion engines are commonly used to power model airplanes, boats, and cars. Model boats and cars also may use battery-powered electric motors, however the internal combustion engine provides higher performance. These model vehicles usually feature remote radio control of the vehicle speed, steering, and in the case of airplanes, the vehicle altitude. The operator uses controls connected to a radio transmitter to transmit signals to a radio receiver on the vehicle that will position the throttle of the engine and control the vehicle steering mechanism using servomotors. The performance of the vehicle depends on many factors, one being the choice of engine design, of which many are available, the size of the engine, which is often limited by the size of the vehicle, and the engine performance characteristics.

Various engine designs are available, including 2 and 4 stroke models, gasoline or nitro-methanol fueled. The 2-cycle nitro-methanol fueled engine is popular due to advantages in the initial cost, the performance for a given space requirement, weight, and the availability of parts and supplies. A typical nitro-methanol 2-cycle engine is a single-cylinder design. Lubrication is by mixing lubricating oil in the fuel, and this fuel-oil mixture is routed through the crankcase prior to entry to the cylinder. The engine has no valves as the fuel-air mixture entry to the cylinder and the exhaust from the cylinder is through ports that are uncovered by the piston near the bottom of the engine stroke. Ignition is by a glow plug, a hot wire in the top of the cylinder. The glow plug is initially electrically heated to start the engine and then retains sufficient temperature for ignition from the heat of combustion. The performance of an engine may vary with the condition of the engine; the fuel-air ratio provided by the fuel control, which is typically a needle valve in the fuel passage to the engine air intake; and the composition of the fuel.

Fuel for the 2-cycle engine is a mixture of methanol; nitro methane, commonly called nitro; and lubricating oil, typically castor oil or synthetic oil. This mixture is often called nitro-methanol. The proportions of the fuel mixture can be varied to obtain the desired engine performance. A variety of fuel component proportions are available pre-mixed or the operator may mix the components. In a given engine, higher performance can generally be obtained by increasing the proportion of nitro methane in the mixture. There is, however, a practical limitation to the nitro methane content that can be effective in boosting performance in a given engine. This limitation is based on the need to provide sufficient lubrication of the engine, compression ratio limitations on the effective use of increased nitro methane content, fuel-air ratio capability of the fuel metering control, and the cooling available to the engine. Increasing the nitro methane content of the fuel will increase engine temperature therefore increasing the need for engine cooling.

Engine cooling for 2-cycle internal combustion nitro-methanol fueled engines varies by the type of vehicle in which the engine is installed. Airplanes generally have good airflow to the engine and small cooling surfaces on the exterior of the engine cylinder and cylinder head provide sufficient cooling. Boat applications typically have the engine enclosed in the boat hull where airflow is minimal, so liquid cooling is provided to the cylinder head which contains water passages. The water passages are provided cooling water flow using the water in which the boat floats. Model cars typically have the engine enclosed by the car body, however provision is made to provide restricted airflow to the engine. An extensive stack of cooling surfaces is provided on the cylinder head for air-cooling. The engine in a model car necessarily has restricted airflow to the head cooling surfaces due to the need to fit around the engine the gear-reduction transmission, engine starting mechanism, steering mechanism, radio receiver and servos, radio battery, and fuel tank. All these components are contained on the chassis beneath the car body. In order to provide a realistic looking model car, the car bodies typically cover the entire chassis. The combination of airflow restrictions surrounding the engine and enclosure in the car body leads to operating problems including loss of power due to overheating.

Experience with operation of nitro-methanol fueled model cars has shown problems that are related to the engine cooling. Operation of these cars in high temperature locations provides erratic performance due to the limited cooling available to the engine causing extreme a engine temperatures. Extreme temperatures shorten the life of engine components, as proper lubrication is more difficult to establish and maintain. Car bodies are generally made of a thin plastic material. In the vicinity of the engine, the plastic is subject to discoloration and deformation from the engine heat. Often the car operator will cut a hole in the car body in the vicinity of the engine to remove or prevent damage and to attempt to improve engine cooling. The resulting model car body is unrealistic looking due to the unsightly hole showing the top of the cylinder head. High engine temperatures also make burn injuries likely when the operator is making engine adjustments.

A model car operator desirous of increasing the performance of a given car does not generally have the option of installing a larger size engine. This is due to the space limitations of the car chassis. The options for engine performance improvement are limited to improving the performance of an engine of the present size. Increases in performance can be made by modifying the engine to increase engine displacement by replacing the cylinder liner, piston and piston rod. Such a replacement is usually also accompanied by a change in fuel composition as the modified parts are generally designed to optimize engine performance at a higher nitro methane fuel content. Simply increasing the fuel nitro methane content also can make a limited performance improvement. Unfortunately these performance improvements increase the heat developed by the engine, resulting in exacerbation of the problems described above of high engine temperature.

There is a need among operators of 2-cycle nitromethanol fueled engine model cars for a way to improve performance without exacerbating the problems the cars have due to poor engine cooling.

SUMMARY OF THE INVENTION

Objects and Advantages

One object of the present invention is to provide a model car engine cooling system that will supplement the engine air-cooling to provide stable performance in warm temperatures.

A second object of the present invention is to provide a model car engine cooling system that maximizes engine cooling for a given model car chassis and body layout.

A third object of the present invention is to provide a model car engine cooling system that provides supplemental cooling without the need to make substantial modifications to the car body.

BRIEF DESCRIPTION OF THE SEVERAL VIEWS OF THE DRAWINGS

FIG. 3 shows an arrangement of the supplemental model car cooling system in a typical model car chassis, a monster truck.

REFERENCE NUMERALS IN DRAWINGS

Figure 1:
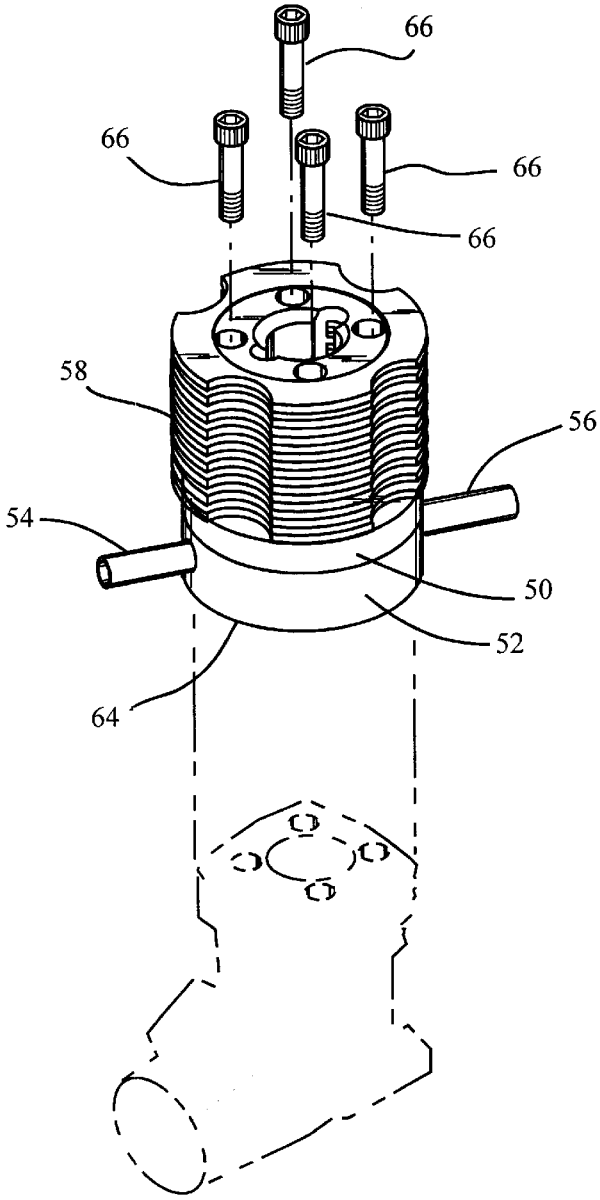
FIG. 1 shows an isometric view of a preferred embodiment of the supplemental model car cooling system cylinder head in which the liquid-cooled portion of the head is located immediately adjacent to the engine cylinder and the air-cooled portion of the head is located immediately above the liquid-cooled portion.

These reference numbers are used in the drawings to refer to areas or features of the supplemental model car cooling system.

50. Liquid- and air-cooled head assembly
52. Liquid-cooled portion of head
54. Liquid coolant inlet
56. Liquid coolant outlet
58. Air-cooled portion of head
60. Glow plug attachment penetration
62. Attachment bolt penetration
64. Head lower attachment surface
66. Head upper attachment surface
80. Liquid coolant reservoir
82. Liquid coolant pump
84. Liquid to air heat exchanger
100. Reservoir to pump liquid pipe
102. Pump to cylinder head liquid pipe
104. Cylinder head to liquid to air heat exchanger pipe
106. Liquid to air heat exchanger to reservoir pipe

DETAILED DESCRIPTION OF THE INVENTION

Preferred Embodiment

The present invention provides supplementary engine cooling to solve performance problems with remotely controlled model cars powered by internal combustion engines. Space limitations, and the desire to maintain the body of the car in its original condition make it difficult or impossible to add supplemental engine air-cooling capability. Supplementary engine air-cooling requires the added hear transfer surface be in contact with the engine, and therefore must be in proximity to the engine. The principle that heat transfer may occur remote from the engine by using a liquid to transfer the heat is exploited in this invention. The present invention uses liquid cooling as a supplement to an air-cooling surface that retains equivalent air-cooling capability to that typically provided on these engines as originally designed, manufactured and sold. Liquid cooling allows use of available space that is remote from the engine for a liquid to air heat exchanger that provides the supplemental heat transfer to the ultimate heat sink, which is the air in the environment.

Many model cars have space available for heat transfer equipment under the body and at or near the front of the car. This available space may be used to supplement engine cooling by installing a liquid to air heat exchanger and associated heat transport system. The transport system provides engine cooling by transferring heat from the engine to a liquid coolant and then transferring this heat from the coolant to the air. Transport system components are a liquid coolant reservoir, pump, liquid- and air-cooled engine head assembly, liquid to air heat exchanger and interconnecting piping.

Figure 2:
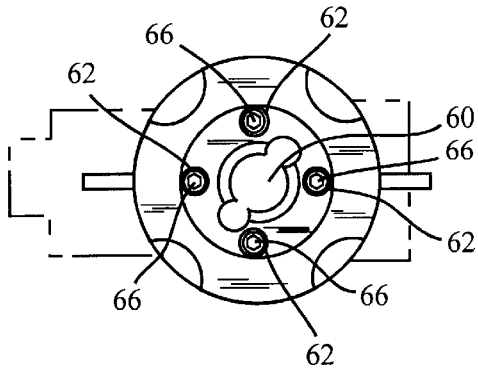
FIG. 2 shows a top view of a preferred embodiment of the supplemental model car cooling system cylinder head in which the liquid-cooled portion of the head is located immediately adjacent to the engine cylinder and the air-cooled portion of the head is located immediately above the liquid-cooled portion.

The preferred embodiment uses a liquid- and air-cooled head assembly (50) as shown in FIGS. 1 and 2. In this embodiment, the liquid-cooled portion of the head (52) is located in the portion of the head that closes the engine cylinder. The entire head assembly is made of thermally conductive metal. Above this liquid-cooled portion of the head assembly an air-cooled portion of the head (58) is attached. The air-cooled portion is a series of thin heat-transfer surfaces joined by spacers that provide for air passages between the heat transfer surfaces. The heat transfer surfaces may be a structure of welded construction or a casting. The liquid- and air-cooled head assembly has a glow plug attachment penetration (60) that is threaded to allow attachment of a glow plug, and head attachment bolt penetrations (62) that allow attaching the head to the engine cylinder using bolts. The bolt heads bear on the head upper attachment surface (66) and cause the head lower attachment surface (64) to contact and compress a seal to close and seal the engine cylinder.

The engine is mounted with the cylinder in a vertical position. Heat produced by combustion of the fuel in the engine will heat the engine head. The hottest portion of the head will be the metal that closes the cylinder. Heat will transfer from the metal to the liquid contained in the liquid-cooled portion (52) of the head. The heat will also transfer to the air-cooled portion (58) of the head where it will transfer to the air flowing by the head.

Figure 3:
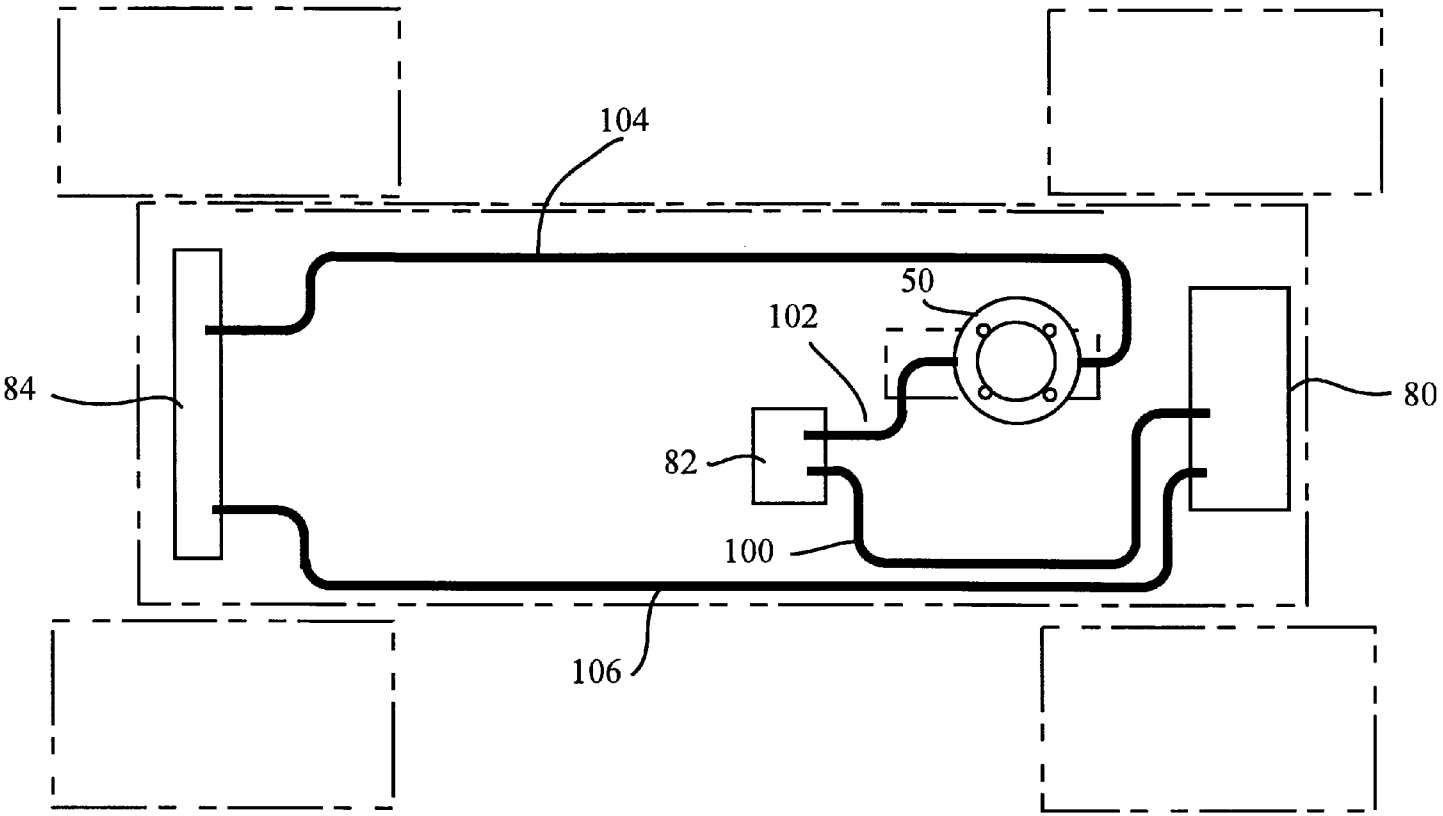
FIG. 3 shows an arrangement of the supplemental model car cooling system in a typical model car chassis, a monster truck, showing the cooling system located between the 2 wheels on each side of the car.

A liquid recirculating system, shown schematically in FIG. 3, maintains liquid coolant flow to and from the liquid cooled portion of tho head. The system components are located between—in other words, in the interval separating—the 2 wheels on each side of the model car. Liquid coolant is stored in a liquid coolant reservoir (80). A pipe (100) connects the bottom of the reservoir to a liquid coolant pump (82). The pump provides the motive force on the liquid for the liquid to flow through a pipe (102) to the cylinder head, through the cylinder head, where heat is transferred to the liquid, and then through another pipe (104) to a liquid to air heat exchanger (84). In the heat exchanger, heat from the liquid is transferred to air flowing past the heat exchanger. The higher temperature of the water, which may approach 200° F., versus the ambient air temperature will cause the heat to transfer, Then the liquid flows from tho heat exchanger through another pipe (106) to return to the liquid reservoir, completing a circuit of the entire system.

The liquid coolant reservoir (80) may be made of a heat-resistant plastic or any material compatible with the liquid coolant chemistry and temperature. The coolant may be clean water or water mixed with anti-freeze. A plastic fuel tank was converted to use as a reservoir on the prototype car.

The piping may be made of plastic or metal tubing, and is arranged to provide the minimum length of piping which fits the arrangement of components in a given car chassis and allows the given car body to be installed on the chassis.

The pump may be of plastic or metal, and of propeller, vane, centrifugal, diaphragm, or electric design, including pizeo electric designs. Many car chassis have a large exposed drive gear directly connected to a small gear on the engine output shaft. The large gear reduces the relatively high engine revolution speed to a lower revolution speed compatible with a model car drive train (gearing, drive shafts and wheels). The pump may be mounted so the car drive gear teeth mesh with and drive a gear on the pump shaft, or may be belt-driven from the engine or gear shaft. The pump used on the prototype installation is a propeller-type pump mounted on the radio battery cover of the car chassis and gear driven from the drive gear. Alternate pump drives may be a pulley from the engine output shaft, gear or drive shaft, or electric drive powered by the radio-control battery.

The liquid to air heat exchanger is of metal or metal and plastic construction to provide good heat transfer. Both aluminum based alloys or copper alloys are satisfactory although other metals may also be used. The size and configuration of the heat exchanger is dependant on the space available in a given car chassis. Some chassis may use more than one physical heat exchangers piped in series. The heat exchanger must be in a location that has good airflow when the car is in motion. The heat exchanger design may be, but is not limited to, finned-tubes or plates through which the hot liquid flows as heat is transferred to the air through the extended heat transfer area provided by the fins.

The size of the heat exchanger which can be accommodated in a given car chassis will determine the sizing of the other components of the system, and ultimately the supplemental heat removal capability.

Additional Embodiments

Figure 4:
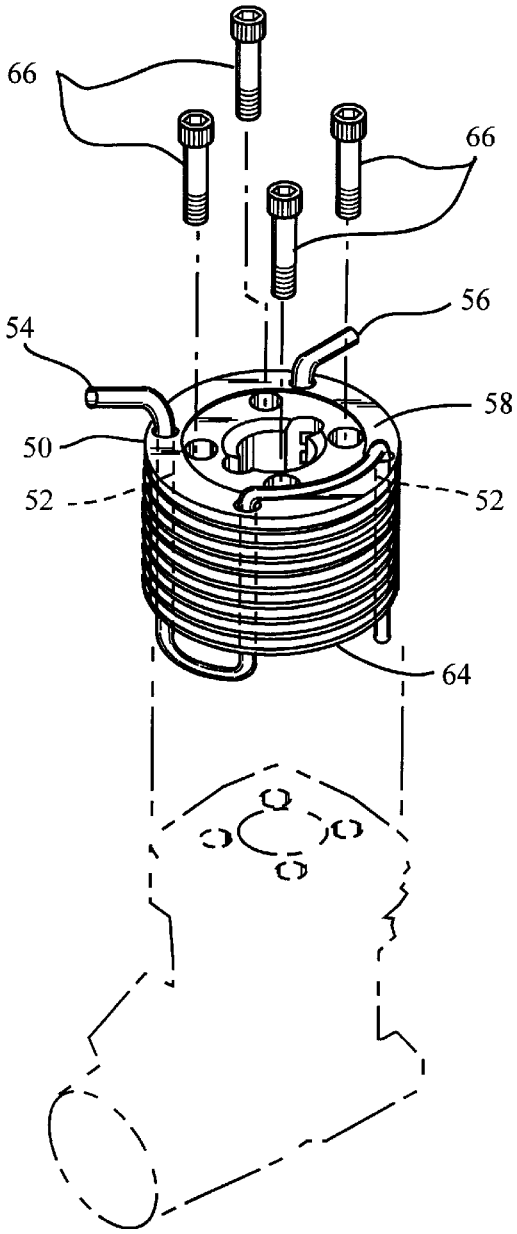
FIG. 4 shows an isometric view of an embodiment of the supplemental model car cooling system cylinder head in which the liquid-cooling passages are located in the air-cooling surfaces.
Figure 5:
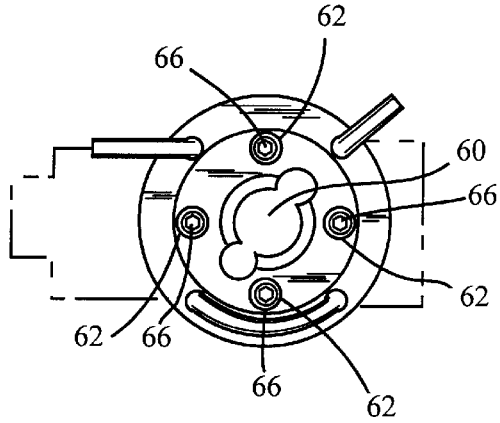
FIG. 5 shows a top view of an embodiment of the supplemental model car cooling system cylinder head in which the liquid-cooling passages are located in the air-cooling surfaces.

An alternate embodiment of the supplemental model car engine cooling system is shown in FIGS. 4 and 5. This embodiment incorporates liquid-cooling passages in the air-cooling surfaces of the cylinder head. The design shown in FIGS. 4 and 5 has straight liquid-cooling passages, each connecting with and transferring heat from all of the cooling surfaces. Alternate designs of this embodiment may also include semi-circular liquid coolant passages that are in contact with and transfer heat from the lower, warmer cooling surfaces.

In this alternate embodiment, the liquid- and air-cooled head assembly (50) consists of an air-cooled portion of the head that is similar to a typical air-cooled model car engine cylinder head, but is modified to provide cooling passages in the air-cooling surfaces. The head cooling is made of metal heat-transfer surfaces separated by spacers that separate the surfaces and provide air passages between the surfaces. The heat transfer surfaces may be a structure of welded construction, or a casting. A lower head attachment surface (64) is the closure for the cylinder and it is made of thicker metal than the heat-transfer surfaces to provide a sufficiently strong sealing surface to seal engine combustion pressures, and an upper head attachment surface (66) that the head attachment bolts bear upon when tightened. The liquid-cooled portion of the cylinder head (52) consist of those portions of the air-cooled surfaces in contact with the liquid-cooling passages. The liquid cooling passages, as shown on FIGS. 4 and 5, start with a coolant inlet (54) and then provide a liquid flow path down the coolant surfaces, around the circumference of the head at the lower surface about 90 degrees and then back up the coolant surfaces to the top of the head, then around the circumference of the head at the upper surface about 90 degrees, and then down the coolant surfaces, again around the circumference of the head at the lower surface about 90 degrees and then the coolant exits the head at the coolant outlet (56).

A characteristic of this alternate embodiment is that the liquid-cooled portion of the head (52), that is for the same heat transfer area to the liquid, will transfer less of the total engine heat load than the preferred embodiment. In the preferred embodiment, as shown in FIG. 1, the liquid-cooled portion of the head (52) is located at the hottest portion of the head, so heat transfer rates will reflect the higher temperature differential at this location. In the alternate embodiment, as shown in FIG. 4, the liquid cooled portion of the head varies from the hottest region, at the bottom of the cylinder head to the coolest region at the upper cooling surface, resulting in reduced heat transfer. This tendency may be used to advantage in avoiding liquid coolant overheating for model cars in which available space severely limits the size of the liquid to air heat exchanger.

Operation

The supplemental model car engine cooling system, if not provided on a car designed to use both air- and liquid-cooling, will be installed as a modification to an existing car chassis. The components of this modification, the liquid- and air-cooled head assembly, the liquid coolant reservoir, the liquid coolant pump, the liquid to air heat exchanger and the interconnecting piping will all be selected to physically fit in available space on the desired car chassis, configured for the engine in the car, while allowing installation of the car body.

Installation requires the existing air-cooled engine head be removed and the liquid- and air-cooled head installed. The liquid coolant pump is mounted so as to be gear driven off the car drive gear, driven from a belt off a pulley installed on the engine output shaft, or gear shaft, or may be electrically driven from the car radio-control batteries. The mounting location for the pump will be in a convenient space as near the liquid coolant reservoir location as possible. The reservoir is mounted wherever space is available, often in the rear of the car chassis. The liquid to air heat exchanger is mounted where there will be good airflow across the cooling fins on the heat exchanger, often in the front of the car chassis. The reservoir, pump, engine head liquid inlet and outlet, and heat exchanger inlet and outlet are interconnected with piping.

The system then must be filled with liquid coolant. Typically clean water, or where freezing of the stored car may occur, a water and antifreeze solution is used. The reservoir is filled and then the car is tipped so the reservoir is the highest location of the liquid system. This fills the heat exchanger and piping. The car may need to be tipped several times to work out air pockets in the piping and heat exchanger.

The car may now be operated with higher nitro methane content fuel, a leaner fuel-air ratio or other engine performance enhancing means without overheating of the engine or body damage from the engine heat.

I claim:

1. A scale-model car internal-combustion engine cooling system installed on a model car with 4 wheels arranged 2 on each side of the car comprising:

a. a cylinder head containing a multiplicity of air-cooled heat transfer surfaces and containing a liquid-cooled portion with a liquid coolant inlet and a liquid coolant outlet, arranged such that air heating space is between the air-cooling heat transfer surfaces thereby engine heat is transferred to air, and further arranged such that a liquid flowing into the inlet, through the liquid-cooled portion, and exiting the outlet also has engine heat transferred to the liquid, b. a liquid to air heat exchanger arranged between the 2 wheels on each side of the nitro-methanol fueled car with a liquid inlet and a liquid outlet, c. a liquid coolant reservoir arranged between the 2 wheels on each side of the nitro-methanol fueled car with a liquid inlet and a liquid outlet, d. a liquid coolant pump arranged between the 2 wheels on each side of the nitro-methanol fueled car with a liquid inlet and a liquid outlet, and e. liquid piping arranged such that liquid coolant in the piping flows from the reservoir outlet, through the pump, through the head cooling passages, through the heat exchanger and back to the reservoir inlet thereby heat is transferred from the cylinder head to the liquid and from the liquid to the heat exchanger, and from the heat exchanger to the air.

2. A scale-model car nitro-methanol fueled internal-combustion engine cooling system installed on a model car with 4 wheels arranged 2 on each side of the car comprising:

a. a cylinder head with attached air-cooling heat transfer surfaces and attached liquid-cooling heat transfer surfaces such that engine heat is transferred by the cylinder head to the air and the liquid coolant, b. a liquid to air heat exchanger arranged between the 2 wheels on each side of the nitro-methanol fueled car with a liquid inlet and a liquid outlet, c. a liquid coolant reservoir arranged between the 2 wheels on each side of the nitro-methanol fueled car with a liquid inlet and a liquid outlet, d. a liquid coolant pump arranged between the 2 wheels on each side of the nitro-methanol fueled car with a liquid inlet and a liquid outlet, and e. liquid piping arranged such that liquid in the piping flows from the reservoir outlet, through the pump, through the head cooling passages, through the heat exchanger, and back to the reservoir inlet thereby heat is transferred from the cylinder head to the liquid and from the liquid to the heat exchanger, and from the heat exchanger to the air.

3. A scale-model car nitro-methanol fueled internal combustion engine cooled cylinder head closure installed on a model car with 4 wheels arranged 2 on each side of the car comprising:

a. a cylinder head closure containing a liquid-cooled portion, and an air-cooled portion, b. the cylinder head closure has a lower attachment surface, an upper attachment surface, a threaded glow plug attachment opening arranged such that the glow plug opening penetrates both surfaces in a central location in the closure, a plurality of unthreaded attachment bolt opening penetrations, the lower surface arranged such that placing the head closure on the engine cylinder opening closes the opening, c. the liquid-cooled portion having a liquid inlet connection, a liquid outlet connection and liquid coolant passages such that liquid passing into the outlet may receive heat from the passage walls as it flows to the outlet, and d. the air-cooled portion comprising a multitude of horizontal heat-transfer surfaces connected and supported vertically by a multitude of vertical heat transfer surfaces, the horizontal surfaces having a central opening and a multitude of attachment bolt openings arranged such that the air-cooling structure may be located on, and attached to the top of the cylinder head closure.

4. The scale-model car nitro-methanol fueled internal combustion engine cooled cylinder head closure installed on a model car with 4 wheels arranged 2 on each side of the car of claim 3 further comprising the liquid coolant passages are arranged internal to the cylinder head closure between the lower attachment surface and the upper attachment surface.

5. The scale-model car nitro-methanol fueled internal combustion engine cooled cylinder head closure installed on a model car with 4 wheels arranged 2 on each side of the car of claim 3 further comprising the liquid coolant passages are arranged in contact with a plurality of the air-cooled portion heat transfer surfaces.

* * * * *